United States Patent [19]

Mitchell et al.

[11] Patent Number: 4,484,364

[45] Date of Patent: Nov. 27, 1984

[54] SHOCK ATTENUATION SYSTEM FOR HEADGEAR

[75] Inventors: Hal D. Mitchell, Rolla, Mo.; David C. Rust, Sacramento, Calif.

[73] Assignee: A-T-O Inc., Willoughby, Ohio

[21] Appl. No.: 456,354

[22] Filed: Jan. 7, 1983

Related U.S. Application Data

[63] Continuation of Ser. No. 185,208, Sep. 8, 1980, abandoned.

[51] Int. Cl.[3] ..... A42B 3/02

[52] U.S. Cl. ..... 2/413; 2/414

[58] Field of Search ..... 2/413, 412, 411, 414, 2/415, 425, 5, 6, 420

[56] References Cited

U.S. PATENT DOCUMENTS

| | | | |
|---|---|---|---|
| 882,686 | 3/1908 | Ireland et al. | 2/413 |
| 1,652,776 | 12/1927 | Galanis | 2/412 |
| 2,585,937 | 2/1952 | Johnson et al. | 2/420 X |
| 3,186,004 | 6/1965 | Carlini | 2/413 |
| 3,600,714 | 8/1971 | Cade et al. | 2/413 |
| 3,829,900 | 8/1974 | Marangoni | 2/414 |
| 4,023,213 | 5/1977 | Rovani | 2/413 |
| 4,133,055 | 1/1979 | Zebuhr | 2/411 |
| 4,172,495 | 10/1979 | Zebuhr et al. | 2/413 |
| 4,223,409 | 9/1980 | Lee | 2/411 |
| 4,343,047 | 8/1982 | Lazowski et al. | 2/411 |
| 4,375,108 | 3/1983 | Gooding | 2/413 |

FOREIGN PATENT DOCUMENTS

| | | |
|---|---|---|
| 0116305 | 12/1942 | Australia . |
| 7829829 | 10/1978 | Fed. Rep. of Germany . |
| 2938355 | 9/1979 | Fed. Rep. of Germany . |
| 2375840 | 12/1977 | France . |
| 1503483 | 2/1975 | United Kingdom . |

*Primary Examiner*—Peter Nerbun

*Attorney, Agent, or Firm*—Senniger, Powers, Leavitt and Roedel

[57] ABSTRACT

A shock attenuation system for headgear having an outer protective shell, the system comprising a liner adapted to be secured to the internal surface of the shell, the liner comprising a series of tubes of elastomeric material extending with their axes generally parallel to the internal surface of the shell, and generally parallel to one another. Each tube is open at an end thereof and is elastically deformable under loads applied against the side of the tube, whereby, with the headgear worn by a wearer and upon application of an impact load to the headgear, the tubes in the area of impact deform elastically under the applied load and attenuate the shock upon the wearer from the applied load.

21 Claims, 7 Drawing Figures

SHOCK ATTENUATION SYSTEM FOR HEADGEAR

This is a continuation of application Ser. No. 185,208, filed Sept. 8, 1980 now abandoned.

BACKGROUND OF THE INVENTION

This invention relates to headgear, and more particularly to a shock attenuation system for protective headgear.

This invention involves an improvement in shock attenuation systems for protective headgear of the type, such as shown for example in U.S. Pat. Nos. 3,292,180, 3,462,763, 3,600,714, 3,609,764, 3,668,704, and 3,887,076, comprising a deformable liner secured to the internal surface of an outer protective shell of the headgear, the liner deforming under an impact load applied to the shell for attenuating the shock upon the wearer. While the liners of prior systems initially provide adequate shock attenuation, they lose a substantial part of their shock attenuation properties with each impact, with the result that after a relatively small number of impact loadings of relatively high magnitude, they no longer provide adequate shock attenuation. The loss of shock attenuation properties is not, however, accompanied by any visible changes in the liners of prior systems, and a user cannot determine by visual inspection whether a particular piece of headgear which has been previously used still provides adequate protection.

SUMMARY OF THE INVENTION

Among the several objects of this invention maybe noted the provision of an improved shock attenuation system of the above-described type which provides a higher level of shock attenuation than prior systems; the provision of such a system which continues to provide an adequate level of shock attenuation after being subjected to numerous impact loadings; the provision of such a system which, if it were to become defective in use, would be visually detectable as such; the provision of such a system which is detachably secured to the outer protective shell of the headgear to enable removal of a defective system and installation of a replacement therefor; the provision of such a system which provides improved air ventilation in the headgear; the provision of such a system which is relatively compact and lightweight; and the provision of such a system which is relatively simple and economical to manufacture.

In general, the shock attenuation system of this invention comprises a liner adapted to be secured to the internal surface of the outer shell of protective headgear, the liner comprising a series of tubes of elastomeric material adapted to extend with their axes generally parallel to the internal surface of the shell and generally parallel to one another. Each tube is open at an end thereof and is elastically deformable under loads applied against the side of the tube, whereby, with the headgear worn by a wearer and upon application of an impact load to the headgear, the tubes in the area of impact deform elastically under the applied load and attenuate the shock upon the wearer from the applied load.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
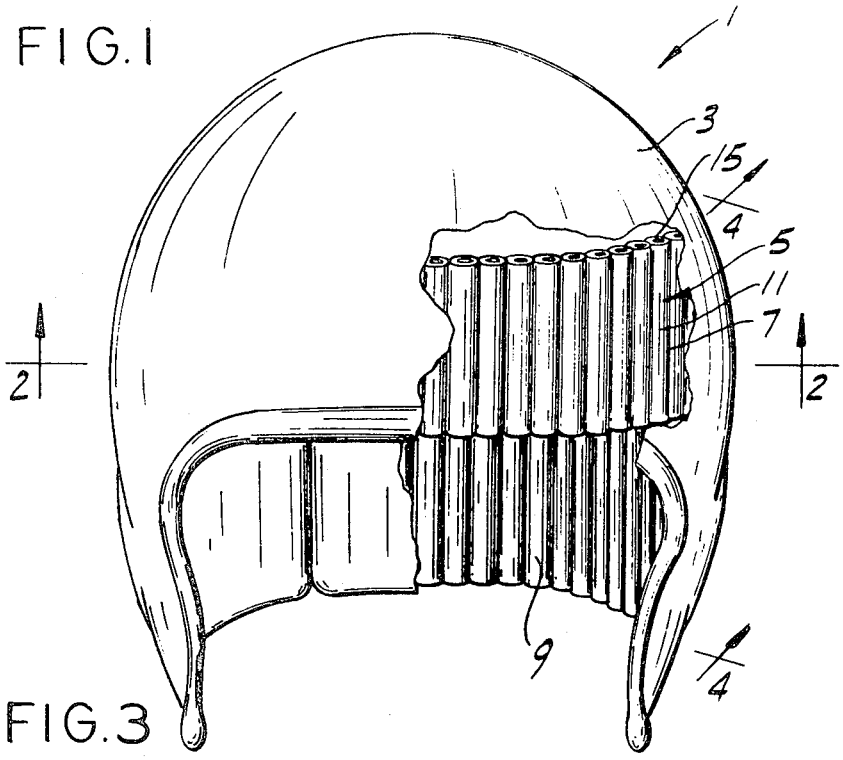
FIG. 1 is a front elevation of headgear having a shock attenuation system of this invention with a portion of the headgear broken away to show a liner of the system and with parts of the liner broken away.
Figure 3:
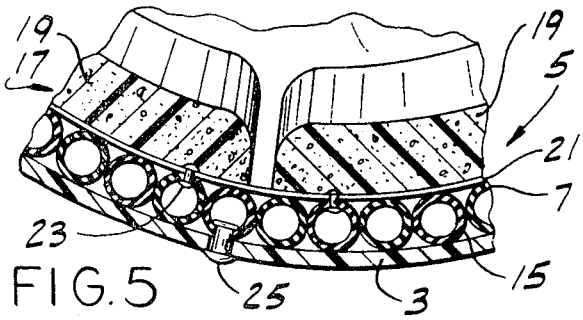
FIG. 3 is an enlarged fragmentary horizontal section of the headgear.
Figure 4:
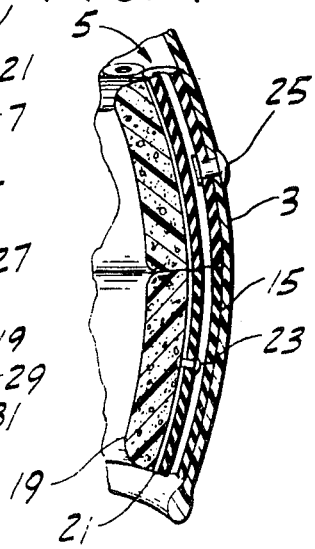
FIG. 4 is a fragmentary vertical section of the headgear on line 4—4 of FIG. 1.
Figure 2:
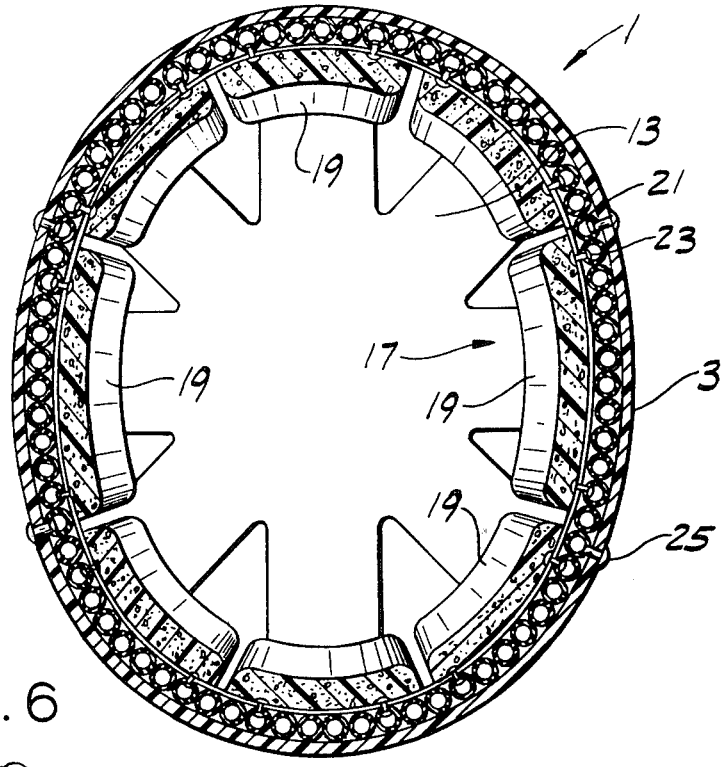
FIG. 2 is a horizontal section of the headgear on line 2—2 of FIG. 1.

Referring first to FIGS. 1-4 of the drawings, there is indicated at 1 headgear, such as a football helmet, comprising an outer protective shell 3 of a suitable relatively lightweight plastic material, such as acrylonitrile-butadiene-system (ABS) resin or polypropylene having a relatively high impact resistance, and a shock attenuation system 5 of this invention comprising a liner 7 around the inside of the shell 3 for protecting the front, back and sides of the head. To facilitate installation of the liner 7 in the shell 3 with the liner 7 held in close conformance to the curved internal surface thereof, the liner preferably has, as shown in FIG. 1, a lower section 9 at the lower edge margin of the shell and a separate upper section 11 above the lower section extending toward but stopping short of the crown of the shell. A suspension system or harness indicated at 13 in FIG. 2 is provided in the headgear 1 at is crown for protecting the top of the wearer's head.

In accordance with this invention, the liner 7 comprises a series of closely spaced elastically deformable tubes 15 of generally circular section extending generally vertically unwardly within the shell from adjacent the bottom edge of the shell to adjacent the crown suspension harness 13, the longitudinal (vertical ) axes of the tubes being generally parallel to the internal surface of the shell. The liner also includes a layer 17 of cushioning material on the inside of the tubes. As shown in FIG. 2, this layer 17 comprises a plurality of pads 19 of a suitable closed-cell elastomeric foam (e.g., a foamed vinyl resin) at spaced at intervals along a carrier sheet 21 of suitable material detachably secured to the tubes 15 by conventional fasteners 23, such as snaps or hook and pile fasteners. The inner surface of the layer 17 of cushioning material is engageable with the head for providing a snug, comfortable fit of the headgear on the wearer's head. The thickness of the layer 17 may be varied within a range (e.g., $\frac{1}{4}$ to $\frac{5}{8}$ inch) to enable use of one size of shell 3 for a range of head sizes.

As shown in FIGS. 1 and 2, the tubes 15 are secured together in generally parallel side-by-side relation with adjacent tubes joined by a layer of suitable adhesive or integrally formed as by extrusion, and they are detachably secured to the shell 3 by conventional fastening means 25 such as rivets, "t" nuts and screws, or snaps. In accordance with this invention, the tubes are of an elastomeric material, such as polybutylene, polyurethane, polyethylene, a polyarylate resin such as that sold under the trade name "Ardel" by Union Carbide Corp., of New York, N.Y., or a synthetic rubber such as that sold under the trade name "Hytrel" by E. I. Du Pont De & Nemours Co., Inc. of Wilmington, Del., and are open at their ends to enable them readily to deform elastically from their normal circular section to an elliptical section under loads applied against their sides. The open ends of the tubes allow air to flow out of the tubes upon being deformed, and also to flow through the tubes to ventilate the headgear 1.

With the headgear 1 worn on a wearer's head, the system 5 attenuates the shock upon the wearer from an impact load applied to the headgear by distributing the loading over an increased area of the head and by increasing the period of time during which loading is applied to the head, thereby decreasing the shock (which is a time derivative of the loading). Thus, upon application of an impact load to the headgear, the tubes 15 in the area of impact elastically deform or flatten from a generally circular cross-sectional shape to a generally elliptical cross-sectional shape in which the major axis of the ellipse extends generally parallel to the inside surface of the shell. This deformation brings the sides of the tubes into engagement with the sides of adjacent tubes, which are thus also elastically deformed into an elliptical cross-sectional shape, but with the major axis of the ellipse extending generally perpendicular to the inside surface of the shell for engagment with the head. This results in the distribution of the impact force over a larger area of the head for reducing the shock felt by the wearer. Moreover, since time is required to deform the tubes upon application of the impact load and additional time is required for the tubes to return to their original circular section after the impact load has been applied, the overall period of time during which loading is applied to the head is increased for further reducing the shock felt by the wearer.

In contrast to the prior shock attenuation systems in which the level of shock attenuation decreases significantly upon subjecting the systems to repeated impact loadings, the system of this invention provides a level of shock attenuation on subsequent impact loadings which is approximately equal to that for the initial impact loading. It is only upon the cracking or fracture of a tube 15 of the liner 7, which may occur after a large number of impact loadings, that there is a substantial decrease in the level of shock attenuation of the system. In further contrast to the prior systems in which visual inspection of the systems does not reveal whether they are still capable of providing adequate protection, in the system of this invention the series of tubes 15 may be easily and quickly removed from the shell 3 and inspected for cracks and fractures, and the headgear 1 may be reconditioned by replacing a series of tubes 15 found to be defective.

Comparison tests of the shock attenuation properties of a football helmet having a shock attenuation system 5 of this invention and three football helmets having prior shock attenuation systems were conducted based on the STANDARD METHOD OF IMPACT TEST AND PERFORMANCE REQUIREMENTS FOR FOOTBALL HELMETS established by the National Operating Committee on Standards in Athletic Equipment (NOCSAE) as revised April, 1977. In each test, a helmet was placed on a test head form having a triaxial accelerometer at its center of gravity, and was dropped ten times in guided free fall from a height of sixty inches onto a rigid anvil in accordance with the test procedures with the front of the helmet impacting the anvil. The "Severity Index" (as specified in the test procedure) of the shock experienced by the head form was calculated for each drop. NOCSAE standards require that the severity index for a helmet not exceed 1500 upon the first or second drop of the helmet.

The four helmets tested were designated A, B, C and D. Helmet A had a liner embodying the shock attenuation system 5 of this invention, comprising tubes of polyurethane having a $\frac{3}{8}$ inch inner diameter and a $\frac{1}{2}$ inch outer diameter, and a layer of 3/8 inch thick vinyl resin foam. Helmet B was of the type such as that shown for example in U.S. Pat. No. 3,462,763 having an air suspension shock attenuation system. Helmet C was of the type such as that shown for example in U.S. Pat. No. 3,609,764 having a shock attenuation system comprising a liner of dual composition vinyl resin foam. Helmet D was of the type such as that shown for example in U.S. Pat. No. 3,600,714 having a hydraulic suspension shock attenuation system. During the testing, it was observed that the Severity Index of the initial drop for the helmets B–D was greater than that for the helmet A, and that the Severity Index of each of the helmets A–D increased on succeeding drops with the increase for helmets B–D on succeeding drops being greater than that for helmet A. Table 1 is a tabulation of the number of times, up to ten, each helmet was dropped until the Severity Index first exceeded 1500.

TABLE 1

NUMBER OF DROPS UNTIL THE SEVERITY INDEX FIRST EXCEEDED 1500

| HELMET | NUMBER OF DROPS |
|---|---|
| A | Not Applicable (Severity Index did not exceed 1500 in ten drops) |
| B | 3 |
| C | 5 |
| D | 4 |

From the Table, it will be observed that the Severity Index for each of helmets B–D exceeded 1500 prior to or upon the fifth drop of the helmet, whereas the Severity Index of helmet A did not exceed 1500 even on the tenth drop.

Figure 5:
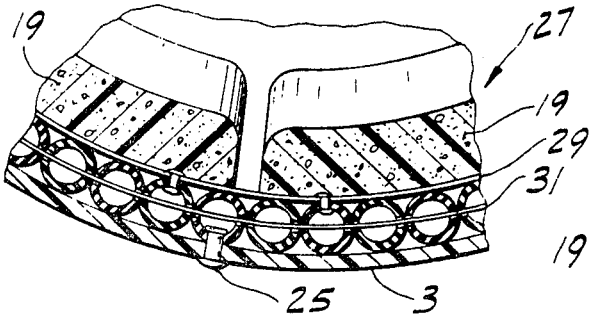
FIG. 5 is a view similar to FIG. 3 showing a second embodiment of the shock attenuation system.

A second embodiment 27 of the shock attenuation system of this invention is shown in FIG. 5. It is similar to the system 5 except that its liner 29 comprises a series of tubes 15 laced together by lacing 31 extending through holes in the sides of the tubes.

Figure 6:
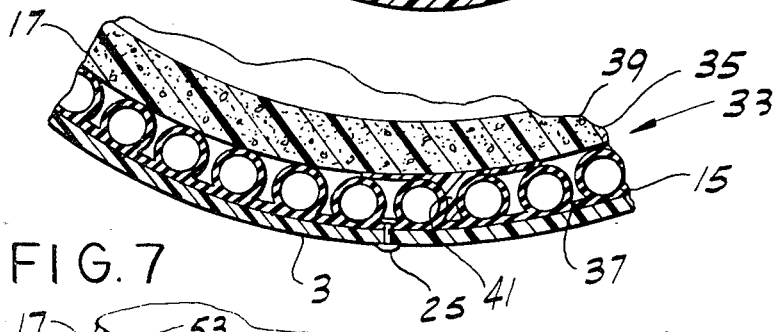
FIG. 6 is a view similar to FIG. 3 showing a third embodiment of the system.

Referring to FIG. 6, a third embodiment 33 of the shock attenuation system of this invention is shown, also similar to the system 5 except that its liner 35 comprises a series of tubes 15 joined to a common carrier sheet 37, which may be of the same elastomeric material as the tubes, with an elongate strip 39 of a suitable elastomeric foam extending around the interior periphery of the series of tubes. As shown in FIG. 5, adjacent tubes 15 may be spaced apart a predetermined distance on the carrier sheet and the fastening means 19 may have a projection 41 extending between adjacent tubes.

Figure 7:
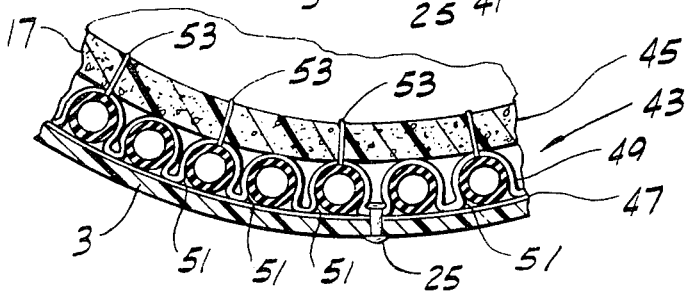
FIG. 7 is a view similar to FIG. 3 showing a fourth embodiment of the system.

Referring to FIG. 7, a fourth embodiment 43 of the shock attenuation system is shown, similar to the system 5 except that its liner 45 further comprises first and second strips 47, 49 of suitable material such as a fabric secured together, as by stitching, at spaced intervals to form means defining a plurality of pockets 51 each receiving a tube 15. This arrangement is advantageous in that it enables replacement of only those tubes found to be defective upon inspection of the liner 45 rather than an entire series of tubes. Like the system 33, adjacent tubes 15 of this system may be spaced apart a predetermined distance and the layer 17 of cushioning material may comprise an elongate strip of elastomeric foam extending around the interior periphery of the series of tubes. As shown in FIG. 7, lacing 53 may be used to secure the layer 17 to the first and second strips 47, 49.

While the shock attenuation systems of this invention have been shown and described as being incorporated in football helmets, it is to be understood that they could be incorporated into other protective headgear, such as aviation helmets and military helmets including those having a bullet-proof outer protective shell. For such applications, the systems of this invention would provide improved ventilation to enable the helmet to be worn for extended periods of time, and would attenuate noise such as that from aircraft engines or gunfire.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Headgear comprising an outer protective shell, a suspension system on the inside of the shell at the crown of the shell for protecting the top of the head, and a shock attentuation system around the inside of the shell for protecting the front, back and sides of the head, said system including a liner comprising a series of relatively long slender open-ended tubes of elastomeric material disposed in generally parallel side-by-side relation, and means for securing the liner on the inside of the shell with the longitudinal axes of the tubes generally parallel to the internal surface of the shell, said tubes being elastically deformable under loads applied against the sides thereof and being spaced sufficiently close to one another that when one tube deforms under a load it is engageable with the sides of adjacent tubes for deforming them whereby when the headgear is worn by a wearer and subjected to an impact load, the sides of the tubes in the area of impact deform elastically under the load into engagement with the sides of adjacent tubes and thereby deform the adjacent tubes for attenuating the shock on the wearer, said tubes being distributed over a relatively large portion of the inside of the shell from adjacent the bottom of the shell to adjacent said crown suspension system for protecting the front, back and sides of the head.

2. Headgear as set forth in claim 1 wherein the liner further comprises an inner layer of cushioning material engageable with the wearer's head.

3. Headgear as set forth in claim 2 wherein the layer of cushioning material is detachably secured to the tubes.

4. Headgear as set forth in claim 2 wherein the cushioning material is a foamed elastomeric material.

5. Headgear as set forth in claim 2 wherein the cushioning material is a foamed vinyl resin material.

6. Headgear as set forth in claim 1 wherein the tubes of the liner extend in side-by-side relation.

7. Headgear as set forth in claim 6 wherein adjacent tubes of the liner are joined together at their sides.

8. Headgear as set forth in claim 6 wherein the tubes are laced together by lacing extending through the sides of the tubes.

9. Headgear as set forth in claim 1 wherein the liner further comprises a carrier sheet, said tubes being joined to said sheet.

10. Headgear as set forth in claim 1 wherein the liner further comprises means forming pockets at spaced intervals adapted to receive said tubes.

11. Headgear as set forth in claim 1 wherein the sides of the adjacent tubes of the liner are spaced apart.

12. Headgear as set forth in claim 1 wherein with the liner secured in the shell the axis of each tube extends generally vertically.

13. Headgear system as set forth in claim 12 wherein the liner comprises a lower section, at the lower margin of the shell, and a separate upper section above the lower section.

14. Headgear as set forth in claim 1 wherein the liner is engageable with and comformable to the internal surface of the shell.

15. Headgear as set forth in claim 1 wherein the tubes are of polyurethane.

16. Headgear as set forth in claim 1 wherein the tubes are of polyethylene.

17. Headgear as set forth in claim 1 wherein the tubes are of polyarylate.

18. Headgear as set forth in claim 1 wherein the tubes are of synthetic rubber.

19. Headgear as set forth in claim 1 wherein said tubes are open ended and in communication with the interior of the headgear whereby when the tubes are deformed during an impact air is adapted to flow out of the tubes and into the interior of the shell for ventilating the headgear.

20. Headgear as set forth in claim 1 wherein said tubes extend generally vertically upwardly from adjacent the bottom edge of the shell to adjacent said crown suspension system.

21. Headgear as set forth in claim 20 further comprising a plurality of pads of cushioning material detachably secured to the tubes on the inside thereof for engagement with the head.

* * * * *